US008610016B2

(12) United States Patent
Yang

(10) Patent No.: US 8,610,016 B2
(45) Date of Patent: Dec. 17, 2013

(54) PLUG WIRE TYPE ZIPPER SWITCH LAMPHOLDER

(75) Inventor: Wen Ho Yang, New Taipei (TW)

(73) Assignee: Rich Brand Industries Limited, Dongguan, Guangdong (CN)

( * ) Notice: Subject to any disclaimer, the term of this patent is extended or adjusted under 35 U.S.C. 154(b) by 268 days.

(21) Appl. No.: 13/221,963

(22) Filed: Aug. 31, 2011

(65) Prior Publication Data

US 2013/0052868 A1 Feb. 28, 2013

(51) Int. Cl.
*H01H 15/00* (2006.01)
*H01H 17/08* (2006.01)

(52) U.S. Cl.
USPC ..... 200/543

(58) Field of Classification Search
USPC ..... 200/537, 543–546, 51.15, 11 A, 413, 200/418, 420, 331
See application file for complete search history.

(56) References Cited

U.S. PATENT DOCUMENTS 5,214,255 A * 5/1993 Fleischhauer ..... 200/51.15
6,171,135 B1 * 1/2001 Yang ..... 439/456
6,880,964 B1 * 4/2005 Yang ..... 362/249.12
6,921,874 B2 * 7/2005 Tseng ..... 200/544

* cited by examiner

*Primary Examiner* — Edwin A. Leon
*Assistant Examiner* — Anthony R. Jimenez
(74) *Attorney, Agent, or Firm* — Bacon & Thomas, PLLC

(57) ABSTRACT

A plug wire type zipper switch lampholder having a zipper for driving a lever and a rotating conductive rod to rotate, so that both ends of a rotating conductive rod jumps between slopes with a first conductive plate and a second conductive plate and slopes without the first conductive plate and the second conductive plate to achieve the operation of switching on and off a light emitting element. In the meantime, a power line can be electrically conducted to an external power supply by a simple plugging process.

3 Claims, 6 Drawing Sheets

PLUG WIRE TYPE ZIPPER SWITCH LAMPHOLDER

BACKGROUND OF THE INVENTION

1. Field of the Invention

The present invention relates to a plug wire type zipper switch lampholder and more particularly to the plug wire type zipper switch lampholder, a zipper directly pulls a rotating conductive rod to rotate, such that both ends of the rotating conductive rod jumps between the slope of the conductive plate and a slop without the conductive plate to achieve the effect of switching a light emitting element on and off; and an external power supply can be connected through a simple and easy measure.

2. Description of the Related Art

Switch lampholder is applied with a light emitting element (such as a bulb) and connected to a power line and an external power supply, and a switch mechanism installed in a switch lampholder for switching a status, and a switch control element (a knob, a push handle or a zipper) is installed to facilitate users to control the light emitting element for the operating of switching ON or OFF the power supply.

With reference to FIG. 1 for a cross-sectional view of a conventional zipper switch lampholder 1, a housing 11 contains an operating member 12, and the operating member 12 includes a plurality of power lines 14 secured and connected by means of a plurality of bolts 13 and conductive screw holes 131 for an electric connection, and the power line 14 passes through a cap 15 coupled to the housing 11 and then extended outwardly and coupled to an external power supply (such as utility power supply, which is not shown in the figure), and the operating member 12 includes a switch mechanism (not shown in the figure) installed therein, a zipper 16 coupled to a side and extended from a trumpet base 161 out of the housing 11, and a screw socket 17 coupled to the bottom, and provided for screwing and coupling an end of a light emitting element (such as a bulb, which is not shown in the figure), and the zipper 16 is provided for users to rotate by hands to control the operating of switching ON or OFF the bulb. In addition, an insulating socket 18 is installed between the housing 11 and the operating member 12 and the screw socket 17 to improve the safety of use. Although the conventional zipper switch lampholder 1 is one of the common daily accessories, the manufacturing cost is still relatively high due to its complicated structure and difficult assembling process. Particularly, when it is necessary to connect with an external power supply, the connection with bolts and conductive screw holes are required, or some people simply adopt a soldering measure to achieve the connection with the external power supply, and this operation is relatively troublesome, and may even cause electric shocks or accidents. Obviously, the conventional zipper switch lampholder requires further improvements.

SUMMARY OF THE INVENTION

In view of the aforementioned problems and drawbacks of manufacturing and using the conventional zipper switch lampholder, the inventor of the present invention based on years of experience in the related industry, and finally designed the present invention to overcome the aforementioned drawbacks.

Therefore, the present invention provides a plug wire type zipper switch lampholder that uses a zipper to pull a rotating conductive rod indirectly to rotate, such that both ends of the rotating conductive rod can jump between a slope having a conductive plate and a slope without the conductive plate, so as to achieve the effect of switching ON and OFF a light emitting element.

Another objective of the present invention is to provide a plug wire type zipper switch lampholder that connects an external power supply through a simple and easy inserting and connecting measure for improving the using safety.

To achieve the aforementioned objective, the present invention provides a plug wire type zipper switch lampholder, comprising: a housing, with an open top and an open bottom, and a connecting portion; an operating member, having a switch mechanism installed therein; a screw socket, coupled to the bottom of an operating member and jointly contained in a housing, and the screw socket having an open bottom and a vertical wall which is a threaded casing provided for screwing a light emitting element, and a plate being installed separately on both sides of a vast majority of the open top, and each plate having a penetrating hole formed thereon; a trumpet base, having a connecting hole, fixed to an operating member and protruded towards the outside; a zipper, coupled into the operating member, and drooped outwardly from the trumpet base; and a cap, having an open bottom, a connecting portion formed at the bottom of the cap, and coupled to the connecting portion at the top of the housing, and a slot formed towards the bottom on a side of the periphery and passed out of the trumpet base, and having a through hole formed at the top for passing in a power line to electrically coupling the operating member; characterized in that the operating member comprises: an upper cover, having a plurality of plug wire holes formed at the top of the upper cover, a plurality of connecting holes, a middle containing groove formed at the bottom of the upper cover, a positioning cavity and a plurality of plate slots interconnected to the plug wire holes respectively, wherein a connecting hole is provided for precisely aligning the connecting hole of the trumpet base, and a connecting element is passed for a connection, such that the trumpet base is fixed to and protruded outwardly from the upper cover, and the plug wire holes are provided for inserting an exposed end of the power line; a lever, having a main body and a plurality of turned blocks with a slope and formed on slopes at the periphery of the top of the main body, an axial column erected from the center, and a containing groove formed at the bottom and penetrated upwardly to the top and a transverse groove penetrated transversally; an axial column, disposed at a position corresponding to a middle containing groove of the upper cover; a turning disk, with a dial block formed on a side, and a passing hole formed at the middle, for sheathing on the axial column of the lever, and a clamp groove formed on another side for passing an inner end of the zipper through the trumpet base to achieve a clamping effect; a torque elastic element, together with a passing hole of the turning disk being jointly sheathed on the axial column of the lever, and then an end of the axial column being inserted and installed into the middle containing groove of the upper cover, and an end of the torque elastic element abutting the turning disk, and the other end abutting a positioning cavity of the upper cover for a positioning effect; an elastic element, contained in the containing groove of the lever; a rotating conductive rod, being substantially a column shape, such that the rotating conductive rod compresses the elastic element to retract into the containing groove to accommodate the rotating conductive rod into the transverse groove and rotated with the lever; and the main body having a plurality of long groove is formed at positions corresponding to the plate slot and the plug wire hole of the upper cover, and a connecting hole is formed at a position proximate to the bottom of the long groove; the connecting hole and the plurality of fixing holes are formed at the periphery of the main body; after the rotating conductive rod compresses the elastic element to retract into the containing groove of the lever, and the rotating conductive rod is received into the transverse groove of the lever, the bottom of the lever together with the rotating conductive rod are jointly inserted into the middle space inside the main body; the main body includes a plurality of slopes formed around the middle space; the main body is covered by the upper cover, such that another connecting hole of the upper cover is aligned with one of the fixing holes and a connecting element is provided for the fixation; a plurality of clamp plates is contained in the long groove, and the top end is bent and abutted into the plate slot of the upper cover for plugging the exposed end of the power line into the plug wire hole, and the bottom end is bent in an opposite direction, and has a penetrating hole attached onto a connecting hole, and then a plurality of connecting elements is passed for the connection; a first conductive plate, which is an oblique plate, having a penetrating hole formed on a side, so that the top of the main body is attached onto the connecting hole, and then a connecting element is passed for the connection, and the position of the oblique plate is aligned towards the center of the main body and abutted against one of the slopes with an inclination; a second conductive plate, which is an oblique plate, having a penetrating hole formed on a side, and clamped between the penetrating hole of one of the clamp plates and the connecting hole, and the connecting element is passed for the connection, such that the clamp plate and the second conductive plate are always electrically conducted, and the oblique portion of the second conductive plate is tilted towards the center of the main body and abutted against another slope obliquely, and a third conductive plate, which is a double-bent plate, having a penetrating hole, and a connecting hole attached onto the bottom of the main body to align precisely with the penetrating hole of the first conductive plate with the connecting hole in between, and then the connecting element is passed for a fixed connection, so that the third conductive plate and the first conductive plate are always electrically conducted, and when the top of the screw socket is attached onto the bottom of the main body, the penetrating hole formed at the top of the screw socket aligns precisely with one of the connecting holes and one of the fixing holes, and one of the penetrating holes is passed through the connecting element of the penetrating hole of one of the clamp plates and the connecting hole and the penetrating hole for a fixed connection, and the screw socket and the clamp plate are always electrically conducted with each other, and after another penetrating hole is aligned precisely with the fixing hole, a connecting element is passed for a secured connection, so as to complete assembling a screw socket with the main body; and a bent protruding position of the third conductive plate remains in the open space at the top of the screw socket and electrically disconnected with the screw socket, such that when use, the zipper is pulled to drive the turning disk to rotate, and on the dial block on the turning disk pushes a turned block to rotate, and link the lever to rotate the rotating conductive rod synchronously, and an electric conduction between the rotating conductive rod and the first conductive plate and the second conductive plate is changed in order, so that the light emitting element is switched ON and OFF accordingly.

In the aforementioned plug wire type zipper switch lampholder, a positioning bump is formed at the middle of the rotating conductive rod and abutted by the elastic element for assisting the positioning effect.

In the aforementioned plug wire type zipper switch lampholder, a micro conductive notch is formed at a front end bent from the top end of the clamp plate for guiding the exposed end of the power line to be plugged.

DETAILED DESCRIPTION OF THE PREFERRED EMBODIMENTS

The technical characteristics and effects of the present invention will become apparent with the detailed description of preferred embodiments accompanied with the illustration of related drawings of the present invention as follows.

Figure 1:
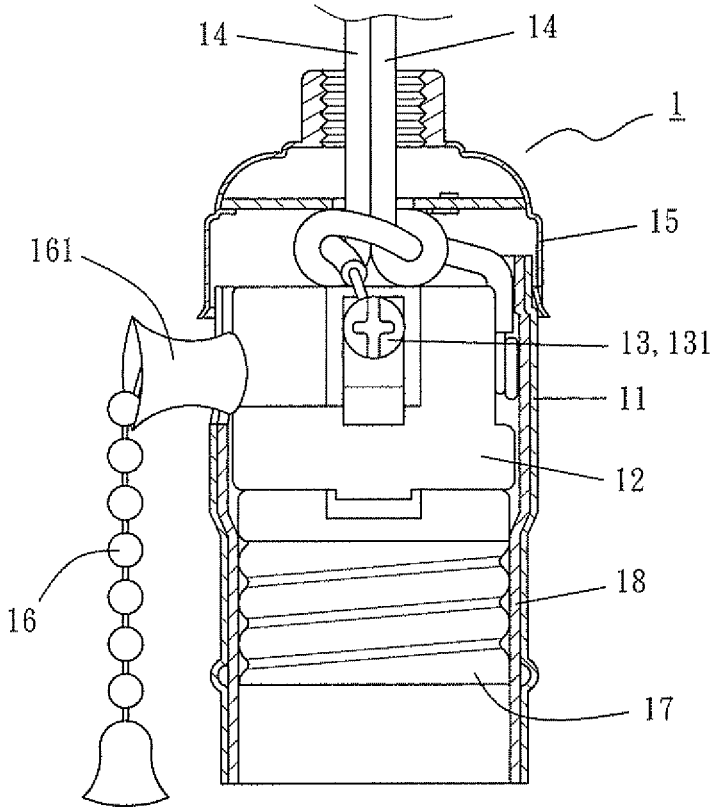
FIG. 1 (PRIOR ART)
FIG. 1 is a cross-sectional view of a conventional assembly.
Figure 2:
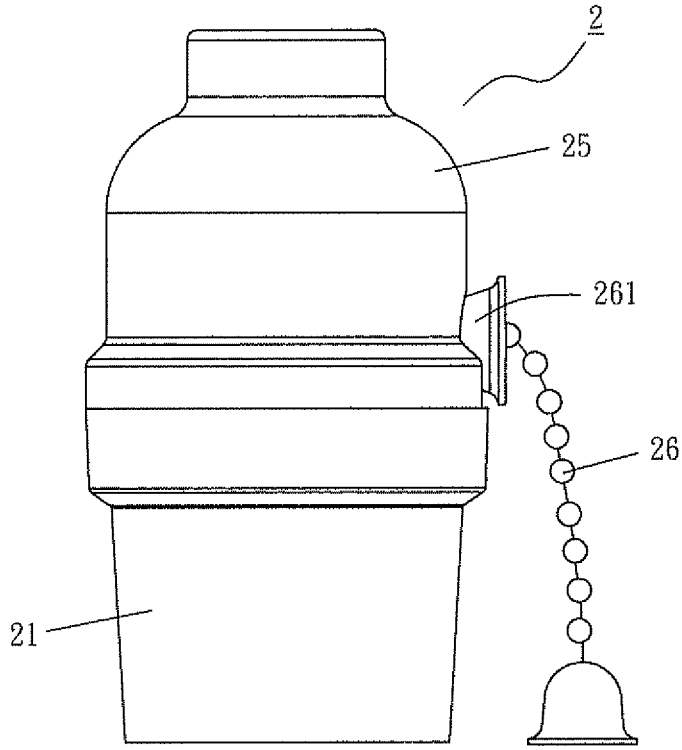
FIG. 2 is a front view of a preferred embodiment of the present invention.
Figure 3:
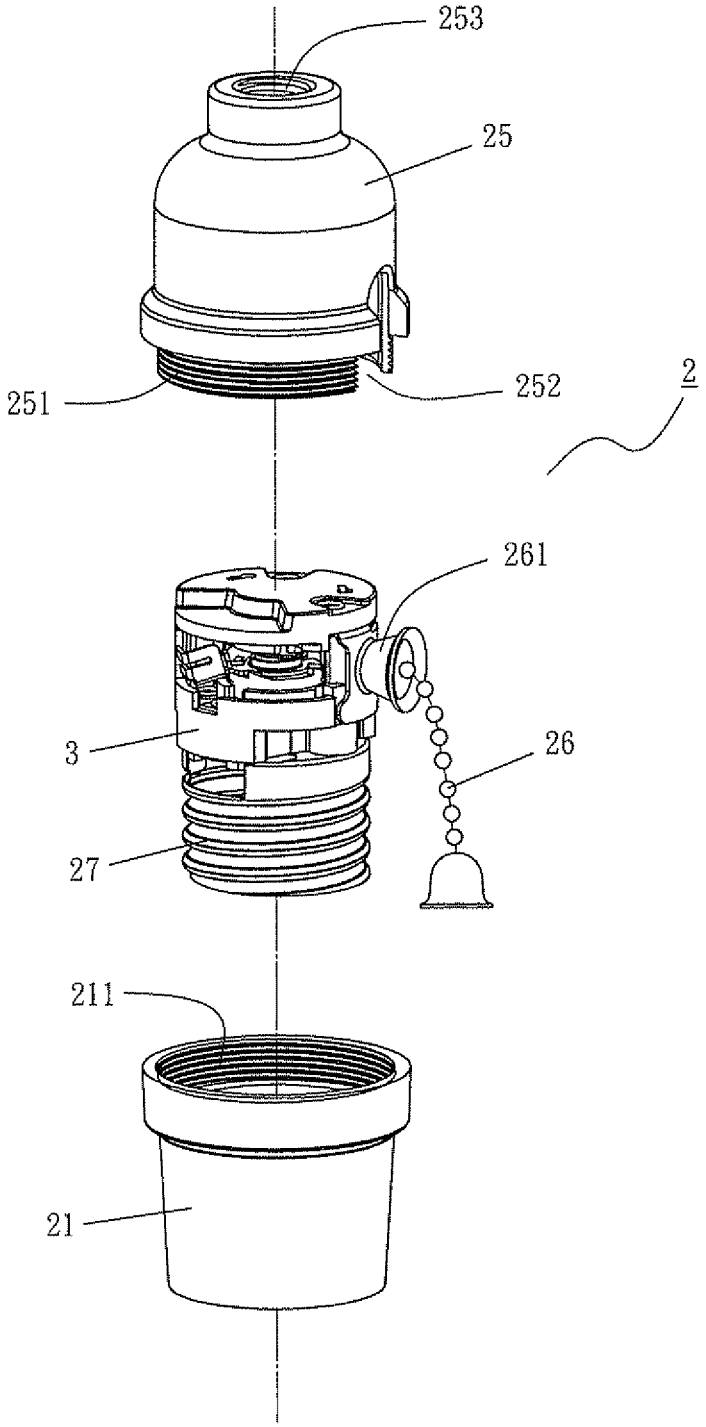
FIG. 3 is an exploded view of a major portion of a preferred embodiment of the present invention.
Figure 4:
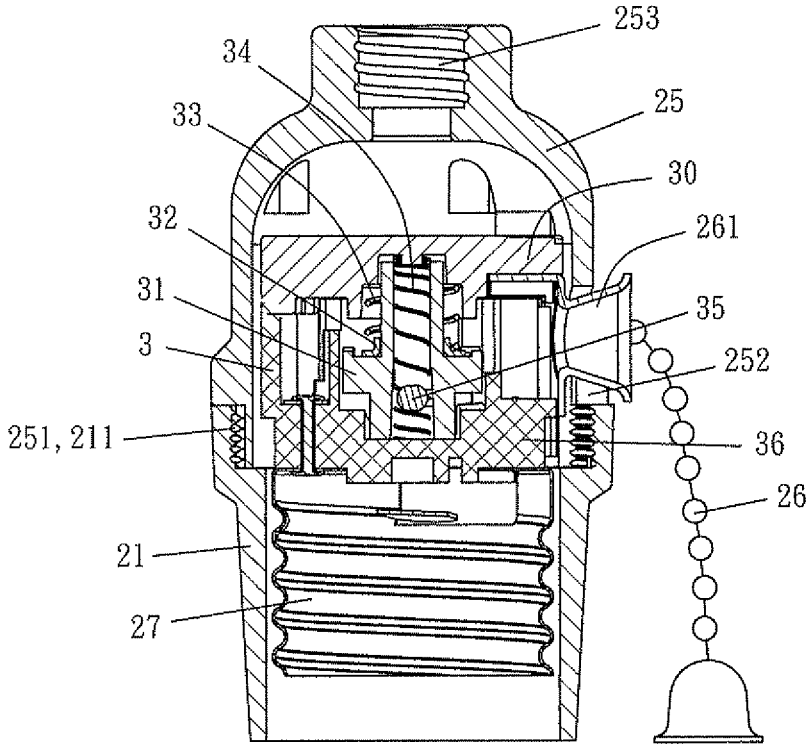
FIG. 4 is a cross-sectional view of a preferred embodiment of the present invention.

With reference to FIGS. 2 and 3 for a switch lampholder in accordance with a preferred embodiment of the present invention, the switch lampholder 2 is a plug wire type zipper switch lampholder, and the switch lampholder 2 comprises a housing 21, an operating member 3, a cap 25, a zipper 26, a trumpet base 261 and a screw socket 27, wherein the bottom of the operating member 3 is coupled to the screw socket 27 to jointly form an integral object, and the operating member 3 includes a switch mechanism therein, and the trumpet base 261 is fixed onto the operating member 3 and protruded to the outside, and the zipper 26 is coupled into the operating member 3 and drooped outwardly from the trumpet base 261; the cap 25 has an open bottom, a connecting portion 251 with an external thread formed on an external periphery of the bottom of the connecting portion 251, a slot 252 opened downwardly from the periphery, a through hole 253 with an internal thread and slightly tapered and formed at the top of the connecting portion 251, and the internal thread being provided for securing with a support element (not shown in the figure). The housing 21 has an open top and an open bottom, and the internal periphery of the top has a connecting portion 211 with an internal thread and secured with the connecting portion 251 of the cap 25. With reference to FIG. 4 for a major assembling, the operating member 3 and the screw socket 27 are combined into an integral object which can be contained in the housing 21, and then the cap 25 is covered thereon, and the connecting portion 251 is secured with the connecting portion 211 of the housing 21, and the integral object formed by integrating the operating member 3 and the screw socket 27 is contained. Now, the trumpet base 261 is passed out from the slot 252, and the zipper 26 is drooped outwardly from the trumpet base 261.

Figure 5:
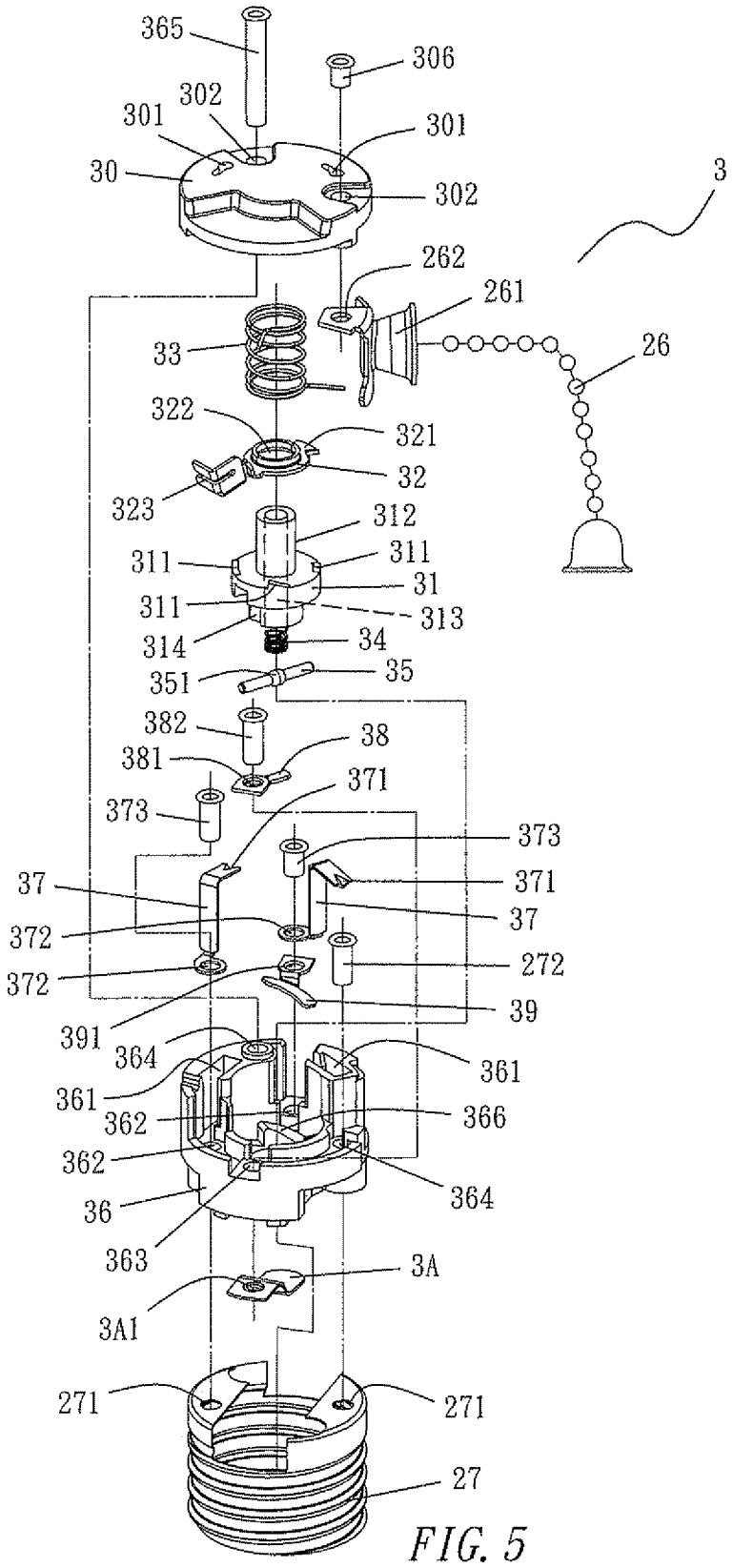
FIG. 5 is an exploded top view of major components of a preferred embodiment of the present invention.
Figure 6:
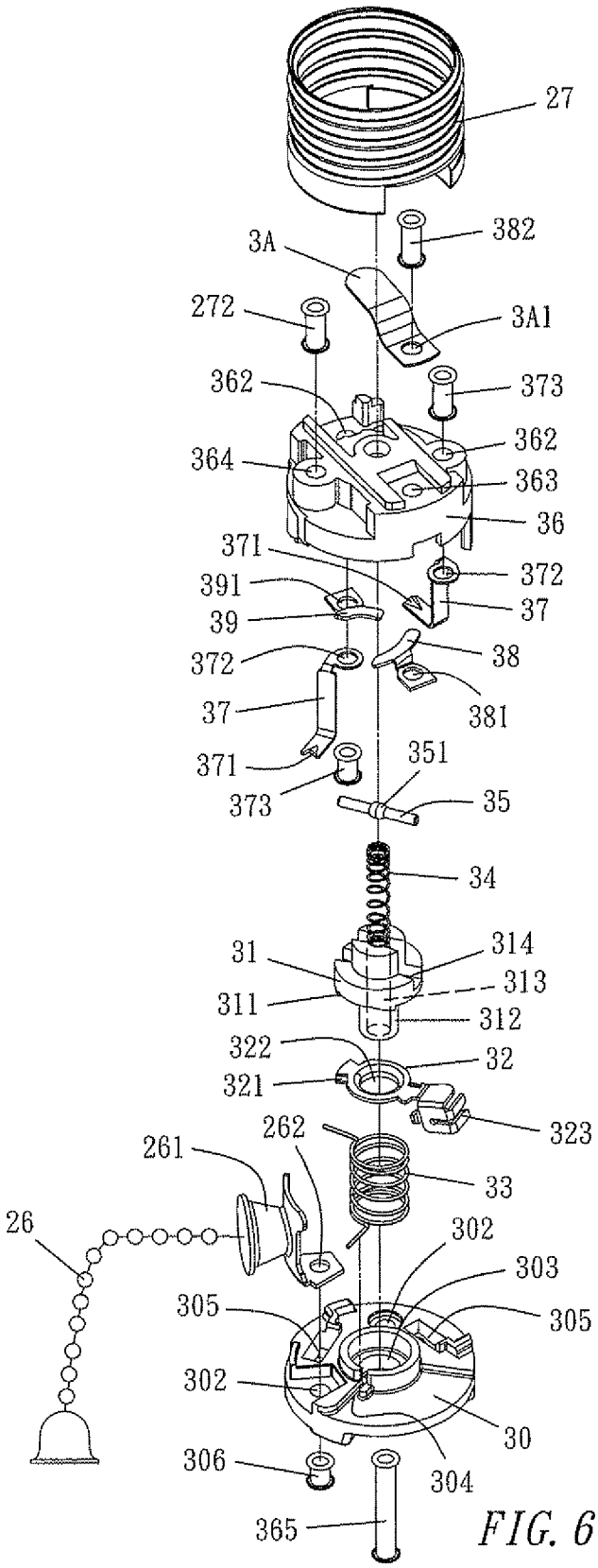
FIG. 6 is an exploded bottom view of major components of a preferred embodiment of the present invention.

With reference to FIGS. 5 and 6, the operating member 3 comprises the following elements:

An upper cover 30 has a plurality of plug wire holes 301, and a plurality of connecting holes 302 formed at the top, and a middle containing groove 303, a positioning cavity 304 and a plurality of plate slots 305 formed at the bottom and interconnected with the plug wire hole 301. The trumpet base 261 includes a connecting hole 262 precisely aligned with one of the connecting holes 302, and then a connecting element 306 (such as a rivet) is provided and passed for a connection, so that the trumpet base 261 can be fixed to the upper cover 30 and protruded outwardly.

A lever 31 includes a main body having a plurality of turned blocks 311 in the shape of a slope formed at different positions around the top, an axial column 312 erected from the middle, a containing groove 313 upwardly interconnected and a transverse groove 314 transversally formed. The axial column 312 corresponds to the middle containing groove 303 of the upper cover 30. A turning disk 32 includes a dial block 321 formed on a side, a passing hole 322 formed at the middle for sheathing on the axial column 312 of the lever 31, and a clamp groove 323 formed on the other side for passing through an inner end of the zipper 26 of the trumpet base 261 for a clamping effect.

A torque elastic element 33 (such as a torque spring) together with the passing hole 322 of the turning disk 32 are sheathed on the axial column 312 of the lever 31, and then an end of the axial column 312 is inserted into the middle containing groove 303 of the upper cover 30, and an end of the torque elastic element 33 is abutted against the turning disk 32, and the other end is pressed into the positioning cavity 304 of the upper cover 30 for positioning.

An elastic element 34 (such as a strip spring) can be contained in the containing groove 313 of the lever 31.

A rotating conductive rod 35 which is substantially in the shape of a strip column, and has a positioning bump 351 formed at the middle and abutted by the elastic element 34 to assisting a positioning effect. During assembling, the rotating conductive rod 35 will compress the elastic element 34 to retract completely into the containing groove 313 to accommodate the rotating conductive rod 35 into the transverse groove 314 and rotate together with the lever 31 (as shown in FIG. 4).

Figure 9:
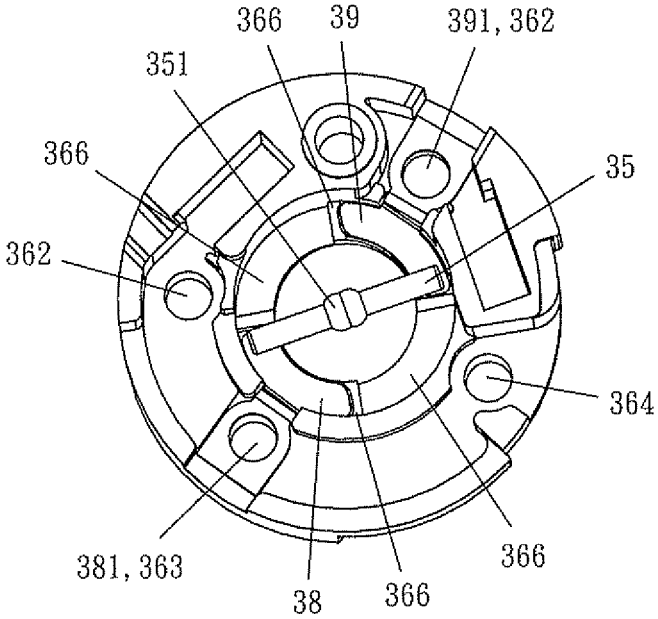
FIG. 9 is a schematic view of achieving the effect of switching on and off components in accordance with a preferred embodiment of the present invention.

A main body 36 includes a plurality of long grooves 361 formed at the top and corresponding to the plate slot 305 and the plug wire hole 301 of the upper cover 30. In the meantime, a connecting hole 362 is formed at a position proximate to the bottom of the long groove 361, and a connecting hole 363 and a plurality of fixing holes 364 are formed at the periphery of the main body 36. As described above, the rotating conductive rod 35 compresses the elastic element 34 to retract into the containing groove 313 of the lever 31, and after the rotating conductive rod 35 is contained in the transverse groove 314 of the lever 31, the bottom of the lever 31 together with the transversally installed rotating conductive rod 35 are inserted into the central space of the main body 36 (as shown in FIG. 4), and the main body 36 includes a plurality of slopes 366 formed around the central space (such as four positions) as shown in FIG. 9. When the aforementioned components are assembled, the upper cover 30 is covered onto the main body 36, so that the other connecting hole 302 of the upper cover 30 is aligned precisely with one of the fixing holes 364, and a connecting element 365 is provided and passed for a secured connection.

Figure 7:
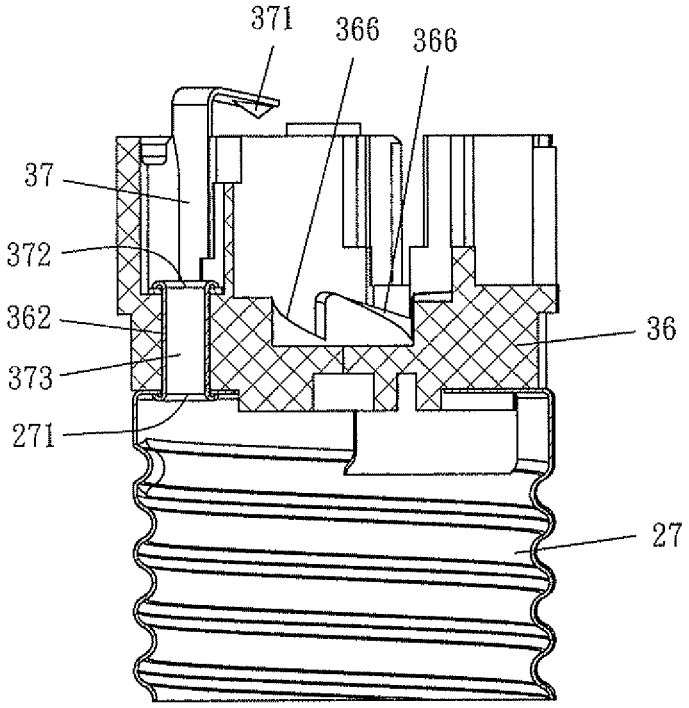
FIG. 7 is schematic view of some components of a preferred embodiment of the present invention.
Figure 8:
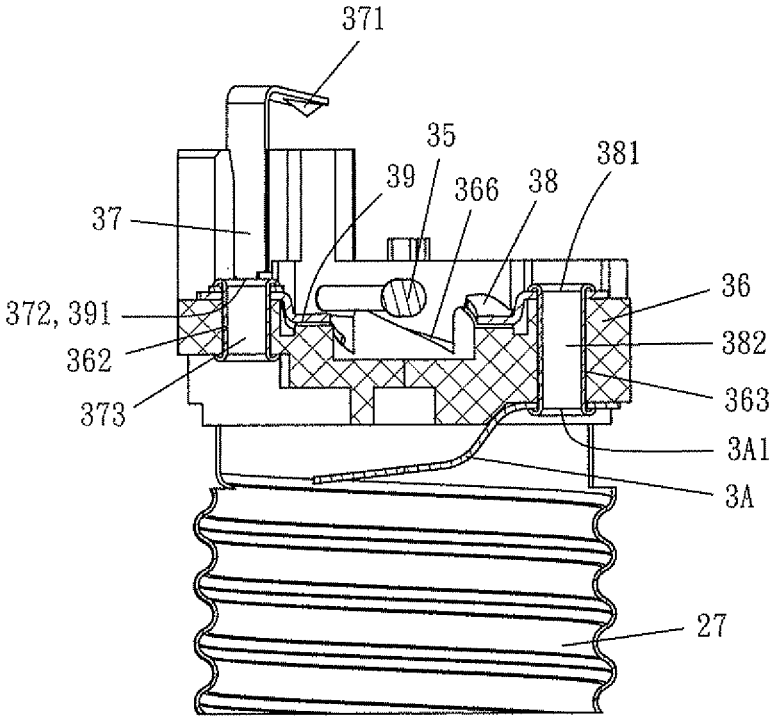
FIG. 8 is a schematic view of assembling some components of a preferred embodiment of the present invention.

A plurality of clamp plates 37 is contained in the long grooves 361 respectively, and a top end is bent to a substantially horizontal level, and abutted into the plate slot 305 of the upper cover 30, and a front end has a micro conductive notch 371 for facilitating plugging the exposed ends of the power line, and the bottom bent in an opposite direction has a penetrating hole 372 attached to a connecting hole 362, and then a plurality of connecting elements 373 (such as rivets) are provided and passed for a connection (as shown in FIGS. 7 and 8).

A first conductive plate 38 is an oblique plate having a penetrating hole 381 formed on a side, and the top of the main body 36 is attached onto the connecting hole 363, and then a connecting element 382 (such as a rivet) is provided and passed for a connection (as shown in FIG. 8), so that the portion of the oblique plate of the first conductive plate 38 is tilted towards the center of the main body 36 and abutted against one of the slopes 366 obliquely.

A second conductive plate 39 is an oblique plate having a penetrating hole 391 formed on a side and included between the penetrating hole 372 and the connecting hole 362, so that the connecting element 373 can be passed sequentially through the penetrating hole 372, the penetrating hole 391 and the connecting hole 362 for a fixed connection (as shown in FIG. 8), and the second conductive plate 39 and a clamp plate 37 are always electrically conducted with each other, and the position of the oblique plate of the second conductive plate 39 is tilted towards the center of the main body 36 and abutted one of the other slopes 366 obliquely.

A third conductive plate 3A is a double bent plate having a penetrating hole 3A1, and the bottom of the main body 36 can be attached to the connecting hole 363, and aligned precisely with the penetrating hole 381 of the first conductive plate 38 with the connecting hole 363 in between, so that the connecting element 382 can be passed sequentially through the penetrating hole 381, the connecting hole 363 and the penetrating hole 3A1 for a fixed connection, and the third conductive plate 3A and the first conductive plate 38 are always electrically conducted with one another (as shown in FIG. 8).

With reference to FIGS. 5 to 9, the screw socket 27 has an open bottom, and a threaded casing formed on the vertical wall for screwing a threaded end of a light emitting element (such as a bulb, which is not shown in the figures), and most of the top are open, and only plates remain on both sides, and a penetrating hole 271 is formed at the top. During assembling, the top of the screw socket 27 is attached onto the bottom of the main body 36, such that the penetrating holes 271 are aligned precisely and respectively with one of the connecting holes 362 and one of the fixing holes 364, so that after a connecting element 373 (such as a rivet) is passed through a penetrating hole 372 and a connecting hole 362, the connecting element 373 will pass through a penetrating hole 271 for a fixed connection, so that the screw socket 27 and one of the clamp plates 37 are always electrically conducted with one another (as shown in FIG. 7), and after the other penetrating hole 271 is aligned precisely with a fixing hole 364, a connecting element 272 (such as a rivet) is provided and passed for a secured connection. After the assembling of the screw socket 27 with the main body 36 is completed, a bent protruding portion of the third conductive plate 3A will stay at the open top of the screw socket 27, so that the third conductive plate 3A and the screw socket 27 are disconnected and situated at an OFF state (as shown in FIG. 8). After the aforementioned components are assembled, the exposed ends of the power line are plugged from the plug wire holes 301 respectively, and the exposed ends are in contact with the micro conductive notches 371 of the clamp plates 37 respectively to conduct the two without any deviation, and then an appropriate force is applied to plug the power line, the exposed ends will push the plates on the micro conductive notches 371 to bend slightly and pass through. Now, the plates of the micro conductive notches 371 resume their original status to clamp and fix the exposed ends of the power line, so that the exposed ends cannot be retracted, and both electrodes of the power supply are electrically conducted to the two clamp plates 37 respectively, and one of the electrodes will be conducted immediately through the penetrating hole 372, the connecting element 373 and the penetrating hole 271 of the conducted clamp plate 37 to the screw socket 27, and the other electrode is conducted through the penetrating hole 372 and the penetrating hole 391 of the clamp plate 37 to the second conductive plate 39.

Now, if the switch lampholder 2 is situated at a state as shown in FIG. 8, the rotating conductive rod 35 is situated between the first conductive plate 38 and the second conductive plate 39, and stays on the slope 366 without the first conductive plate 38 and the second conductive plate 39. In other words, the rotating conductive rod 35 is not in contact with the first conductive plate 38 and the second conductive plate 39, so that the current conducted to the second conductive plate 39 will not be conducted to the first conductive plate 3, and will not be conducted to the third conductive plate 3A. Even if the threaded end of the light emitting element is screwed precisely into the screw socket 27, the whole circuit is disconnected at an OFF state, and the light emitting element is situated at an OFF state.

The user can pull the zipper 26 by a hand to drive the turning disk 32 to rotate. In the process, the dial block 321 of the turning disk 32 will push one of the turned block 311 to rotate, such that the lever 31 with its rotating conductive rod 35 at the bottom are rotated synchronously. In the process, as long as the rotating conductive rod 35 rotates, both ends will move upwardly from the original position on the slope 366 (referred to as the slope without the conductive plate) without the first conductive plate 38 and the second conductive plate 39. When the ends pass the vertex of the slope 366, they fall on the slopes 366 with the first conductive plate 38 and the second conductive plate 39 respectively (referred to as the slopes with the conductive plates), and the rotating conductive rod 35 electrically conduct the first conductive plate 38 and the second conductive plate 39, and the current is passed to the third conductive plate 3A, such that the whole circuit is electrically conducted to an ON state, so as to turn on the light emitting element instantly.

In the process of pulling the zipper 26 to drive and rotate the turning disk 32, the torque elastic element 33 is compressed, so that as long as the user releases one hand, the resilience of the torque elastic element 33 will force the turning disk 32 to resume its original position. The lever 31 linked by the rotating conductive rod 35 is blocked by the side walls protruded from a position next to the bottom of the first conductive plate 38 and the second conductive plate 39, so that both ends of the rotating conductive rod 35 can stay at the lowest position of the slope of the conductive plate, and the lever 31 also stays at that position.

When the user wants to turn off the light emitting element, the user just pulls the zipper 26 once again to drive the turning disk 32 to rotate a turned block turning block 311, so that the lever 31 and the rotating conductive rod 35 at its bottom are rotated synchronously. In the process, both ends of the rotating conductive rod 35 are moved upwardly along the first conductive plate 38 and the second conductive plate 39. Until these ends reaches the top, they fall immediately into the slope 366 (which is the slope without the conductive plate) without the first conductive plate 38 and the second conductive plate 39, and the first conductive plate 38 and the second conductive plate 39 are disconnected with each other to switch to an OFF state, so as to turn off the light emitting element, and the rotating conductive rod 35 will stay at the lowest position of the slope without the conductive plate, and wait for the next pulling and rotation.

In summation of the description above, the present invention simplifies the assembly of the zipper switch lampholder, so that the lampholder can be assembled and used easily, wherein a simple way of plugging the power line provides the effect of conducting the external power supply. Unlike the prior art that requires a screwing tool or a soldering tool for the electrical conduction, the present invention provides a simple and easy application and improves the safety of the application. By pulling the zipper to turn the lever, the rotating conductive rod is driven and rotated, so that both ends of the rotating conductive rod can jump between a slope with the first or second conductive plate and a slope without the first or second conductive plate to achieve the operation of switching on and off the light emitting element. The zipper switch mechanism of the invention improves over the prior art and complies with the patent application requirements, and is thus duly filed for patent application.

While the invention has been described by means of specific embodiments, numerous modifications and variations of the link rod mechanism could be made thereto by those skilled in the art without departing from the scope and spirit of the invention set forth in the claims.

What is claimed is:

1. A plug wire type zipper switch lampholder, comprising: a housing, with an open top and an open bottom, and a connecting portion formed at the top of the housing; an operating member having a switch mechanism installed therein, a screw socket coupled to the bottom of the operating member and jointly contained in the housing, and the screw socket having an open bottom and a vertical wall which is a threaded casing provided for screwing a light emitting element, and a plate being installed separately on both sides of a vast majority of the open top, and each plate having a penetrating hole formed thereon; a trumpet base, having a connecting hole, fixed to an operating member and protruded towards the outside; a zipper, coupled into the operating member, and drooped outwardly from the trumpet base; and a cap, having an open bottom, a connecting portion formed at the bottom of the cap, and is coupled to the connecting portion at the top of the housing, and a slot formed towards the bottom on a side of the periphery and passed out of the trumpet base, and having a through hole formed at the top for passing in a power line to electrically coupling the operating member; characterized in that the operating member comprises: an upper cover, having a plurality of plug wire holes formed at the top of the upper cover, a plurality of connecting holes, a middle containing groove formed at the bottom of the upper cover, a positioning cavity and a plurality of plate slots interconnected to the plug wire holes respectively, wherein one of the connecting holes is provided for precisely aligning the connecting hole of the trumpet base, and a connecting element is passed for a connection, such that the trumpet base is fixed to and protruded outwardly from the upper cover, and the plug wire holes are provided for inserting an exposed end of the power line; a lever, having a main body and a plurality of blocks formed on slopes at the periphery of the top of the main body, an axial column extending from the center of the lever, and a containing groove formed at the bottom and penetrated upwardly to the top and a transverse groove penetrated transversally the axial column being disposed at a position corresponding to a middle containing groove of the upper cover; a turning disk, with a dial block formed on a side, and a passing hole formed at the middle, for sheathing on the axial column of the lever, and a clamp groove formed on another side for passing an inner end of the zipper through the trumpet base to achieve a clamping effect; a torque elastic element, together with a passing hole of the turning disk being jointly sheathed on the axial column of the lever, and then an end of the axial column being inserted and installed into the middle containing groove of the upper cover, and an end of the torque elastic element abutting the turning disk, and the other end abutting a positioning cavity of the upper cover for engagement therewith an elastic element contained in the containing groove of the lever; a rotating conductive rod, being substantially a column shape, such that the rotating conductive rod compresses the elastic element to retract into the containing groove to accommodate the rotating conductive rod into the transverse groove and rotated with the lever; and the main body having a plurality of long grooves formed at positions corresponding to the plate slot and the plug wire hole of the upper cover, and a connecting hole is formed at a position proximate to the bottom of the long groove; the connecting hole and the plurality of fixing holes are formed at the periphery of the main body; after the rotating conductive rod compresses the elastic element to retract into the containing groove of the lever, and the rotating conductive rod is received into the transverse groove of the lever, the bottom of the lever together with the rotating conductive rod are jointly inserted into the middle space inside the main body; the main body includes a plurality of slopes formed around the middle space; the main body is covered by the upper cover, such that another connecting hole of the upper cover is aligned with one of the fixing holes and a connecting element is provided for securing the upper cover to the main body, a plurality of clamp plates is contained in the long groove, and the top end of each clamp plate is bent and abutted into the plate slot of the upper cover for plugging the exposed end of the power line into the plug wire hole, and the bottom end of each clamp plate is bent in an opposite direction and has a penetrating hole attached onto a connecting hole, and a plurality of connecting elements are passed through the penetrating and connecting holes for connecting the upper cover to the main body, for the connection; a first conductive plate, which is an oblique plate, having a penetrating hole formed on a side, so that the top of the main body is attached onto the connecting hole, and then a connecting element is passed for the connection, and the position of the oblique plate is aligned towards the center of the main body and abutted against one of the slopes with an inclination; a second conductive plate, which is an oblique plate, having a penetrating hole formed on a side, and clamped between the penetrating hole of one of the clamp plates and the connecting hole, and the connecting element is passed for the connection, such that the clamp plate and the second conductive plate are always electrically conducted, and the oblique portion of the second conductive plate is tilted towards the center of the main body and abutted against another slope obliquely, and a third conductive plate, which is a double-bent plate, having a penetrating hole, and a connecting hole attached onto the bottom of the main body to align precisely with the penetrating hole of the first conductive plate with the connecting hole in between, and then the connecting element is passed for a fixed connection, so that the third conductive plate and the first conductive plate are always electrically conducted, and when the top of the screw socket is attached onto the bottom of the main body, the penetrating hole formed at the top of the screw socket aligns precisely with one of the connecting holes and one of the fixing holes, and one of the penetrating holes is passed through the connecting element of the penetrating hole of one of the clamp plates and the connecting hole and the penetrating hole for a fixed connection, and the screw socket and the clamp plate are always electrically conducted with each other, and after another penetrating hole is aligned precisely with the fixing hole, a connecting element is passed for a secured connection, so as to complete assembling a screw socket with the main body; and a bent protruding position of the third conductive plate remains in the open space at the top of the screw socket and electrically disconnected with the screw socket, such that when used, the zipper is pulled to drive the turning disk to rotate, and on the dial block on the turning disk pushes a turned block to rotate, and link the lever to rotate the rotating conductive rod synchronously, and an electric conduction between the rotating conductive rod and the first conductive plate and the second conductive plate may be changed so that the light emitting element may be switched ON and OFF accordingly.

2. The plug wire type zipper switch lampholder of claim 1, wherein the rotating conductive rod includes a positioning bump formed at the middle of the rotating conductive rod and abutted by the elastic element for engagement therewith.

3. The plug wire type zipper switch lampholder of claim 1, further comprising a micro conductive notch formed at a bent front end of the top end of the clamp plate includes for engagement by the exposed end of the power line to be plugged.

* * * * *